United States Patent [19]

La See

[11] Patent Number: 4,550,542

[45] Date of Patent: Nov. 5, 1985

[54] VISION PANEL FRAME

[75] Inventor: Jack La See, 308 West Cedar, Abbotsford, Wis. 54405

[73] Assignee: Jack La See, Abbotsford, Wis.

[21] Appl. No.: 639,066

[22] Filed: Aug. 9, 1984

[51] Int. Cl.[4] ..... E06B 3/62; E06B 1/04

[52] U.S. Cl. ..... 52/476; 52/455; 52/656; 52/824

[58] Field of Search ..... 52/475, 476, 208, 656, 52/455, 397, 824, 400, 211, 821, 825; 428/34

[56] References Cited

U.S. PATENT DOCUMENTS

| | | | |
|---|---|---|---|
| 1,668,696 | 5/1928 | Plym | 52/475 |
| 2,614,665 | 10/1952 | Floyd | 189/75 |
| 2,693,257 | 11/1952 | Bongiovanni | 189/75 |
| 2,773,571 | 12/1956 | Kelly | 189/75 |
| 2,814,801 | 5/1965 | Fletcher | 20/11 |
| 2,831,553 | 4/1958 | Pollock | 189/77 |
| 2,834,997 | 5/1958 | Webb | 20/36 |
| 2,852,113 | 9/1958 | Bancroft | 52/475 |
| 2,871,524 | 2/1959 | Wille et al. | 20/56.4 |
| 2,934,800 | 5/1960 | Hasbrouck et al. | 52/397 |
| 2,944,305 | 7/1960 | Avery | 20/36 |
| 3,203,052 | 8/1965 | Curtis, Jr. | 20/39 |
| 3,363,365 | 1/1968 | Laepple | 49/505 |
| 3,566,656 | 3/1971 | Pond | 52/208 |
| 3,760,543 | 9/1973 | McAllister | 52/397 |
| 3,861,099 | 1/1975 | Faudree | 52/211 |
| 3,961,452 | 6/1976 | Hubbard et al. | 52/475 |
| 3,969,857 | 7/1976 | Stark | 52/208 |
| 4,259,818 | 4/1981 | Stark | 52/824 |

*Primary Examiner*—Stuart S. Levy
*Assistant Examiner*—Lloyd D. Doigan
*Attorney, Agent, or Firm*—Quarles & Brady

[57] ABSTRACT

A vision unit which can be easily assembled into the opening in a door such as a fire door which is constructed so that it can withstand high temperatures without disintegration. The vision unit is readily assembled into an opening in the door by one person working alone. The vision unit is composed basically of two frame members, two lower support elements and a biasing element which extends between the wall surface at the top of the opening and one of the support arms of the frame. The support arms include sharp edge portions for contacting a transparent panel member. Securing means such as threaded nuts and bolts or screws pass through the door opening and fasten the frame members to the door as well as to the panel member.

25 Claims, 9 Drawing Figures

FIG.5
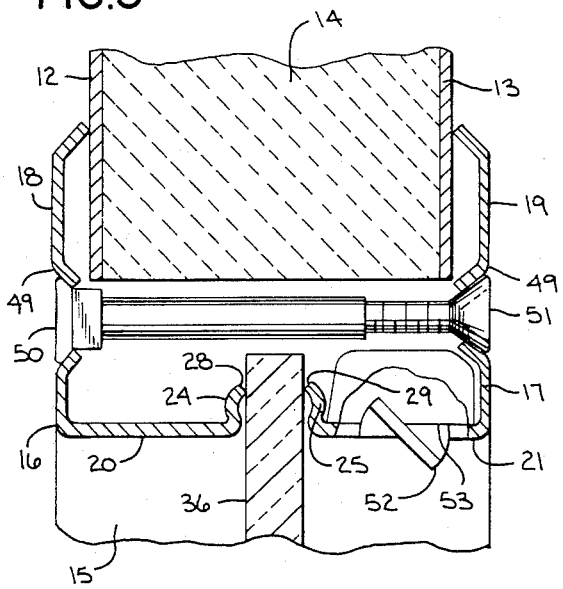
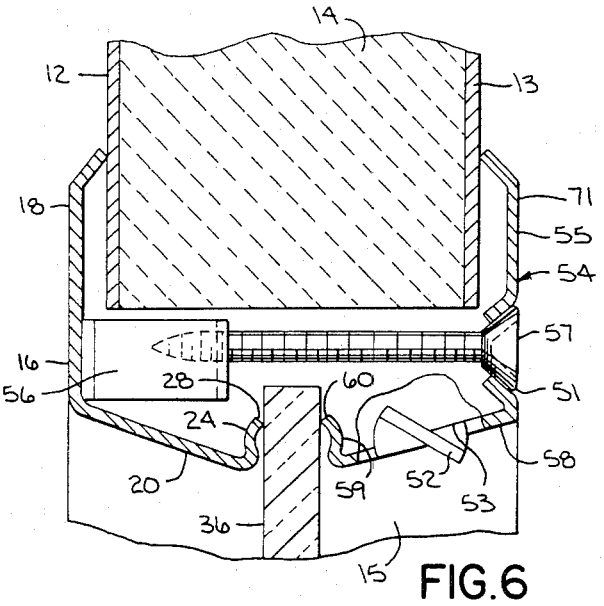
FIG.6
FIG. 7
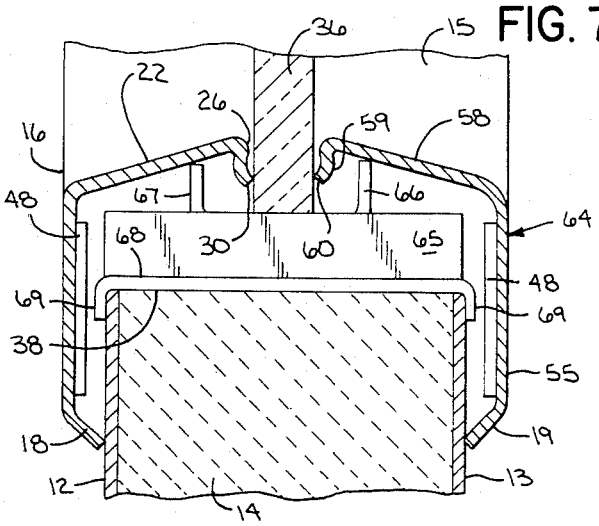
FIG.8
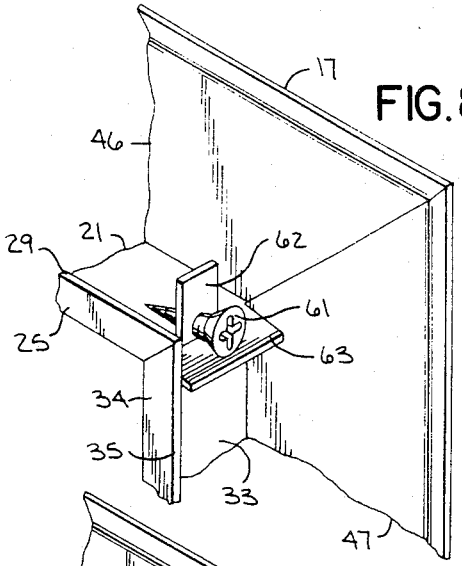
FIG.4
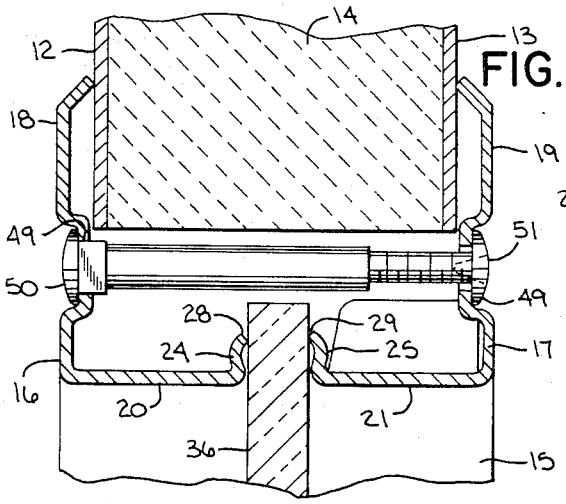
FIG.9
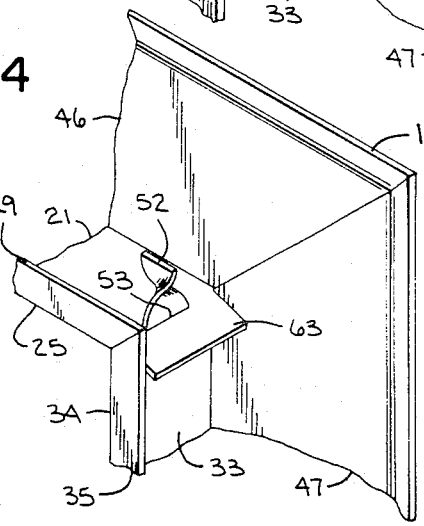

VISION PANEL FRAME

BACKGROUND OF THE INVENTION

This invention relates to a vision unit which is easily assembled into the opening of a door. More particularly, this invention relates to a frame structure for a vision panel approved for use in a fire door wherein the frame structure can be easily assembled yet will secure the approved wire glass even if sprayed with a fire hose after 1½ hours in a 1700° F. fire.

There are currently available vision panel frames for doors which use frame members having opposing wide flat steel surfaces to secure the glass. The frame members are joined by through bolts or screws. The screws apply clamping pressure to the glass and the door faces. Since the contact area between the frame and the glass is quite large, the clamping pressure per square inch is very low. The design of this invention reduces the contact area between glass and frame to a single edge. The frame of this invention also positions the thru bolts very close to the glass, increasing the percentage of clamping pressure applied to the glass. These two features dramatically increase the clamping force per square inch applied to the glass. Since this clamping force is high per square inch, the frame described herein will embed its clamping edge into the semi-molten glass of a 1700° F. fire, holding the glass securely, whereas currently available vision panel frames having considerably less clamping force per square inch on the glass, will allow the semi-molten, sagging glass to slip out of the frame in a hot fire.

Another disadvantage of currently available vision panel frames is that they must be of one piece welded construction to pass required fire tests. Currently available frames are very fragile until installed and shipping is a major problem. The bulk of the shipping carton, along with the fragile contents, results in significant shipping damage. In a preferred manner, each unit of the frame of this invention can be manufactured as eight individual linear sections to form the sides of the frame. These sections can be packaged in a strong, tubular package and easily shipped without damage. The eight pieces can be easily assembled at the job site just prior to installation in the fire door. Another disadvantage of currently available vision panel frames is that the door must be drilled to provide the holes for the screws. This installation operation is expensive as the door must be drilled from both sides to prevent splintering of the door skin. The vision panel frame herein disclosed allows the screws to pass thru the door cutout, eliminating the need to drill screw holes. There is also available a window unit as described in U.S. Pat. No. 3,969,857 wherein the fastening screws pass inside the door cutout and engage a flange which engages the glass on the opposite side. In this particular design, the glass can be very easily broken if the screw tension is not drawn up properly. While this design does allow one face of the frame to be without screw holes, it does not result in the two sides being not symmetrical and two different cross sections must be manufactured to make one complete frame. This results in expansion of inventory. Further, this particular frame structure is not easily assembled by a person acting alone.

It is an advantage of the present invention to provide a vision unit which is easily assembled yet can withstand the high rigors of heat and other adverse conditions. It is still another advantage to provide a frame unit for a vision panel which can be easily installed by a person acting alone from a ready to assemble kit. Other advantages are a simplified frame structure for a fire door, which is composed of a minimum number of parts thereby reducing inventory costs while at the same time offering versatility in design.

SUMMARY OF THE INVENTION

The foregoing advantages are accomplished and the shortcomings of the prior art are overcome by the present vision panel unit which is composed of first and second frame members which are adapted to be mounted in the opening in a door and from opposite sides thereof. The two frame members have flange sections which overlie the peripheral edges of the opening in the door. Support arms extend toward each other from the frame members and into the opening and define an open continuous holding channel for a transparent panel member. The support arms include sharp edge portions for contacting the panel member. In one embodiment, a biasing element extends between a wall surface of the door opening and one of the support arms. Support elements are positioned between the first and second frame members and close the open channel to support the bottom of the panel member. Securing means in the form of threaded screws or nuts and bolts pass through the opening in the door and clamp the first and second frame members to the door and to the panel member which is preferably glass. The frame can be formed into two sections which are interconnected by a welded fastening at the corner or preferably by interconnecting tab and slot members or a fastening screw at the job site. In a preferred manner, the biasing element is provided by a spring member adapted for contact over a major portion of the width of the wall surface forming the door opening. The support elements which are positioned between the frame members for supporting contact with the glass panel member also have raised portions for engagement with the bottom support arms. Also, preferably, the securing means which are provided by threadable screw members are positioned in close proximity to the edge portions clamping the glass. The securing means for fastening the frame members together can be a variety of threaded screw members such as those of the binder post type or as represented by a nut which is welded in place and engageable by a threaded screw or bolt. The support arms are positioned at an angle preferably of about 90 degrees with the frame member or 15 degrees from being square thereto. Also, preferably, the sharp edge portions for contacting the glass are interconnected to the support arms by angular finger portions which provide a biased holding of the panel member.

BRIEF DESCRIPTION OF THE DRAWINGS

A better understanding of the present vision panel frame will be accomplished by reference to the drawings wherein:

FIG. 4 is a partial view in vertical section illustrating the fastening of the vision panel frame shown in FIGS. 1–3.

FIGS. 5–7 are views similar to FIG. 4 except showing alternative embodiments of the invention.

FIG. 8 is a partial view in perspective depicting an alternative method of fastening the frame members of the vision panel frame.

FIG. 9 is a view similar to FIG. 8 showing still another means of securing the frame members together.

DESCRIPTION OF THE EMBODIMENT

Figure 1:
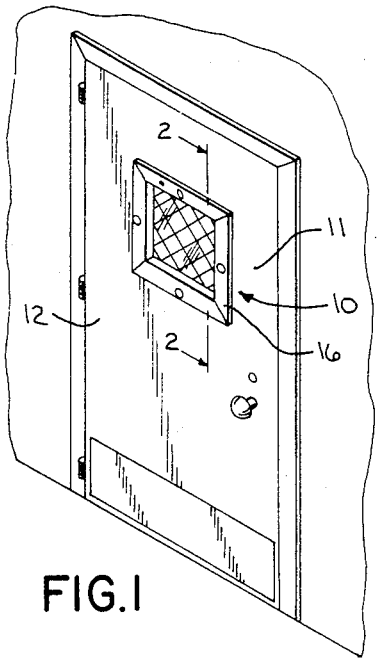
FIG. 1 is a view in perspective showing the vision panel frame in a typical fire door installation.
Figure 2:
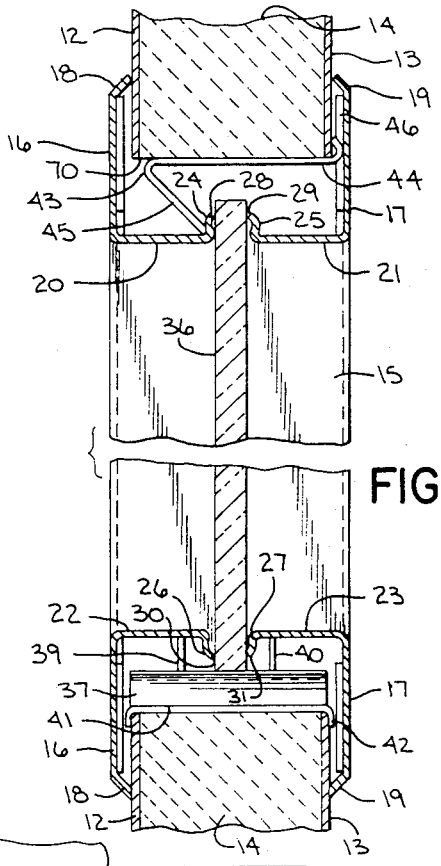
FIG. 2 is an enlarged sectional view taken through line 2—2 of FIG. 1.
Figure 3:
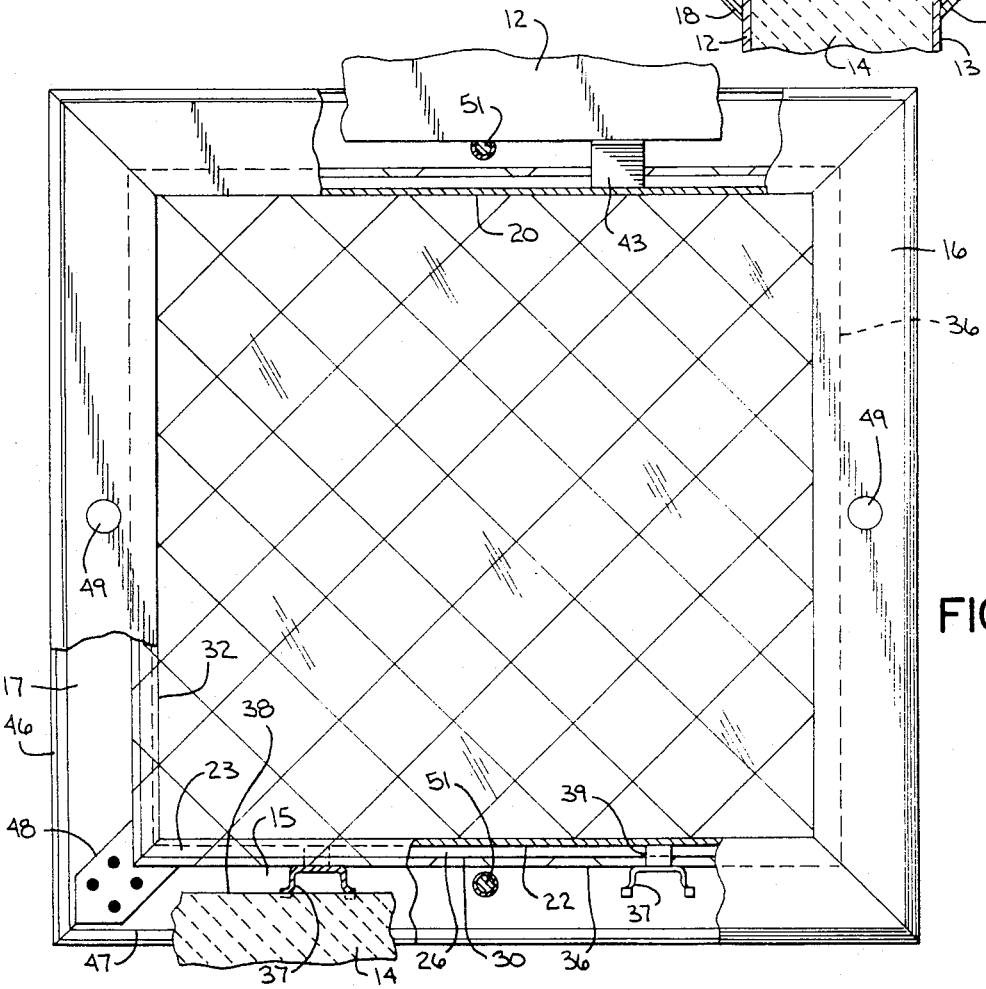
FIG. 3 is an enlarged side elevational view of the vision panel frame shown in FIG. 1 with various portions broken away.

Proceeding to a detailed description of the present invention, the vision panel unit generally 10 is utilized in conjunction with a typical fire door 11 which, as best seen in FIGS. 1 and 2, will have the usual wooden front panel 12 and a wooden back panel 13 with an insulative panel 14 in between. A door opening 15 of the usual square or rectangular configuration will be provided in the door 11 and will receive the identical and opposing frame members 16 and 17 with the frame member 16 being positioned on the front of the door 11 and the frame member 17 on the back. Each frame member has a flange section 18 and 19 for extending over adjacent, peripheral portions of the door surrounding opening 15. The frame members 16 and 17 are each formed of four side pieces. The top side pieces of the frame members 16 and 17 have an upper support arm such as 20 and 21 and the bottom side pieces have a lower support arm 22 and 23, respectively. The support arms terminate in finger portions 24, 25, 26 and 27 each having an edge portion 28, 29, 30 and 31. It will be appreciated that additional support arms will extend into the opening from the left and right side pieces of the frame members as well as from the top and bottom. This is best seen in conjunction with FIG. 3 as well as FIGS. 8 and 9. In FIG. 3 a vertical support arm such as 32 is shown in conjunction with frame member 17 and in FIGS. 8 and 9 a vertical extending support arm 33 with a finger portion 34 and an edge portion 35 is also shown in conjunction with frame 17. In effect, the horizontally positioned support arms 20–23 in addition to the vertically extending support arms such as 32 and 33 provide a rectangular frame structure which defines a space or open holding channel for glass panel 36 inside opening 15 with the vertically extending support arms having opposed finger portions spaced from each other in the manner indicated for the finger portions 24–27.

The edges 28–31 at the end of the finger portions 24–27 are sharp. As will be explained in greater detail hereafter, the sharp edges function to grip the glass panel 36 particularly when the glass is subjected to heat.

Referring to FIGS. 2 and 3, it will be seen that two support elements 37 are positioned over a lower edge 38 of door opening 15. The support elements 37 partially close the open channel and support the bottom edge of the glass panel 36. The support elements include upright raised portions 39 and 40 for support of the support arms 22 and 23. Each support element 37 is securely held over the edge 38 by means of a foot section 41 which is coextensive therewith and the end portions 42 of which are curved to engage a small portion of the front and back panels 12 and 13 of the door. At the top of door opening 15 a spring clip 43 extends over a major portion of the width of the top edge of the opening 15 with a leg section 44 in contact therewith. An arm portion 45 of the spring member 48 extends downwardly in an angular manner to contact the finger portion 20 of one of the frames. As will be explained in greater detail hereafter, the spring member 43 assists in assembly of the frames. The four sides of each frame member may be formed by two right angle sections such as sections 46 and 47 as best seen in FIG. 3. The two sections are jointed at the two corners by weld fastenings 48.

Referring specifically to FIG. 4 it will be seen that the flanges 18 and 19 of the frame members 16 and 17 include an opening such as 49 for receiving a nut 50 as well as a screw 51. In this instance, the nut and screw are of the binder post type commonly used in book bindings.

FIG. 5 depicts a different and preferred means for fastening the opposing sides of the frame members together. In place of a weld fastening 48, a tab 52 projects from one of the frame sections and is fastened through an opening 53 in the other frame section by being bent in a twisting action. This is also illustrated in FIG. 9.

FIG. 5 also shows a flat head binder post alternative embodiment allowing for a flush appearance. It will be seen that nut 50 presents a square cross section under the head for fitting into a mating square hole in flange 18. This allows one side of the door to be tamper-proof as the screw 51 can be removed from only one side of the door.

FIG. 6 illustrates an alternative embodiment generally 54 utilizing a different means of fastening the opposing frame members such as front frame member 16 and a back frame member 55 together. In this particular embodiment there are three differences from the embodiment 10. The first is the use of a welded-in-place nut 56 for threadable engagement with a screw 57 and a tamper-proof feature similar to FIG. 5. The second is an alternate cross-section shape, support arm 58 as well as support arm 20, which extends inwardly into door opening 15 and is not square but instead is at a slight angle of about 15 degrees. However, the support arms 58 and 20 do include finger portions 59 and 24 with edge portions 60 and 28, respectively, for engagement with the glass panel 36. Still another difference is in the preferred means by which the frame portions are connected by the tab 52 extending through the opening 53 on the other frame section in the manner previously described in conjunction with FIG. 5. Referring to FIG. 8 it will be seen that the two frame parts such as 46 and 47 can also be interconnected with a common sheet metal screw 61 suitably threaded through a tab 62 which will extend from support arm 33 upwardly through a suitable slot in support arm 21. An extension 63 of frame part 46 is provided for the purpose of engaging the head of screw 61.

The embodiment generally 64 shown in FIG. 7 is similar to the embodiment 54 in having the angled support arm 58 extending into the door opening 15 for engagement with glass panel 36. The support arm 58 will similarly include a finger portion 59 and an edge portion 60 for contact with glass panel 36. In this instance the same type of a support element 65 is employed with extensions or raised portions 66 and 67 for engagement with the angled support arms 58 and 20. This support element will have a foot section 68 for extending over the lower edge surface 38 as well as an end portion 69 for retention thereon. Another difference between embodiment 64 and embodiment 54 is in the utilization of the weld fastenings 48 to join the two frame components 46 and 47 of the frame members 16 and 55 as previously indicated for the embodiment shown in FIG. 3.

OPERATION

A better understanding of the advantages of the vision panel of this invention will be had by a description of its method of installation. The use of all of the embodiments of this invention are similar in their installation in the door opening 15 so only the embodiment 10 which is shown in FIGS. 1–4 will be specifically described. It will be appreciated that, as previously indicated, the front frame 16 and back frame 17, although initially formed in two sections such as 46 and 47, will be joined such as by weld fastening 48. As the vision panel is composed of few components it is easily supplied in a packaged kit form for assembly. In order to install any of the frame members, and particularly frame members 16 and 17, all that is required is the placement of the two frame supports 37 over the lower edge 38 of opening 15. This is best seen in FIG. 3. Subsequently, the front frame 16 will be inserted in place as indicated in FIG. 2 with the spring member 43 positioned with the arm portion 45 behind the finger portion 24 of the support arm 20 and the leg section 44 placed across the upper edge 70 of the door opening 15. With this placement, the frame member 16 will be self supporting in the door opening 15. Glass panel 36 will then be placed against the edge portions such as 28 and 30 with glass also resting on the support elements 37. The back frame member 17 will then be set in place with the edge portions such as 29 and 31 resting against the opposite side of glass panel 36. Four nuts such as 50 will then be placed through the openings 49 in the front frame 16 and four screws such as 51 will be similarly placed through the openings 49 in the back frame member 17.

In the instance of the embodiment 54 it will be appreciated that the fastening between a front frame member 16 and a back frame member 55 with flange 71 will be accomplished by the screws 57 engaging the nuts 56 which will be fastened to the front frame member 16. As indicated earlier, it will be further appreciated that glass panel 36 will not only be held at the top and bottom in the door opening 15 and in a horizontal manner but also vertically between the finger portions such as 34 and edge portion 35 which will project from vertically extending support arms such as 32 or 33 and from both the front and back frame members as shown in FIGS. 3, 8 and 9. This in effect will provide a rectangular and continuous open holding channel for the glass inside the front and back panel members as illustrated in FIG. 3. The embodiments generally 54 and 64 of FIGS. 6 and 7 depict an angled support arm 58. This is for the purpose of providing a beveled appearance should one be desired.

The advantages of the vision panel unit of this invention will be further appreciated by the following tests which were conducted at Warnoch Gersey Test Labs in Antioch, Calif. A 45 minute fire door with the vision panel unit 10 including the glass 36 was installed and clamped to the face of a furnace with one side being exposed to 1640° F. flame and the other side to the room. The test results are indicated as follows:

| ELAPSED TIME | FURNACE TEMP. °F. | EXPOSED FACE |
|---|---|---|
| 1 min. | 300 | The wired glass glazing panel started to craze-crack in a random pattern. |
| 1 min., 45 sec. | 500 | The door skin ignited with luminous yellow flames spreading across the surface. |
| 8 min. | 1250 | The door skin was consumed. |
| 15 min. | 1400 | The ash remaining from the cross-banding had not yet fallen from the door. No other visual changes are apparent at this time. |
| 29 min., 30 sec. | 1550 | No visual changes are apparent at this time. |
| 43 min. | 1620 | The glazing continued to take on a slightly more milk appearance. No other visual changes are apparent at this time. |
| 45 min. | 1640 | The fire test was stopped at this time. |

At 45 minutes of exposure, the furnace was extinguished and the test assembly was moved into position for a hose stream test. A hose stream test was conducted against the exposed face of the test assembly for 10 seconds with a water pressure of 30 psi as measured at the base of the nozzle.

The glass craze-cracked with a very fine pattern forming, but no fracturing or displacement of the glass occurred at any point. No through openings developed in the glass, frame or door. On the side of the door exposed to the room, a small amount of charring occurred along the top of the frame members 16 and 17. The assembly appeared to be in an excellent survival condition. This test was repeated with similar results. From the above tests, a fire door has been developed by the present vision unit 10 and approved for commercial use. It can be indicated for use up to 1½ hours under fire conditions.

The features which offer such rigidity under such adverse conditions for the vision unit of this invention are the use of the fastening members such as the nut and screw 50 and 51 passing through the door cutout 15 and their positioning close to the pointed and sharp clamping edges such as 28, 29, 30 and 31, of the respective support arms 20, 21, 22 and 23. This clamping action by the sharp edges is also aided by the biasing effect provided by the curved finger portions 24–27 when the frame members are fastened together. This dual clamping feature in combination with the close positioning of the fastening members effects secure holding of glass panel 36 especially when the glass becomes semi-molten. When the glass becomes semi-molten the clamping edges embed themselves into the glass, securing it even when sprayed with a fire hose. As previously indicated such clamping edge action will be on both sides of glass panel 36 as well as at the top, at the bottom and on both sides in a continuous rectangular manner.

In the description of the embodiment herein the metal frame members as represented by 17 and 18 and the associated support arms 20–23 are all formed from steel. However, if desired other materials such as stainless steel could be utilized. Further, while the vision support panel of this invention has been illustrated in conjunction with the fire door having the wooden panels 12 and 13 with an insulative panel 14 in between, if desired it could be utilized in conjunction with a steel door or with other non-fire doors such as those fabricated from solid wood cores or foam or paper cores. Further, while an approved wire glass panel 36 has been indicated for use in the vision panel unit, in a non-fire door application any type of transparent material could be placed between the support arms of frame members such as thermosetting material as represented by plexiglas or Lexon. While certain types of fastening means have been illustrated to afford a tamper-proof feature in conjunction with the frame members such as 16 and 17, one way screws or other tamper-proof screws could as readily be employed.

It will thus be seen through the present invention there is now provided a vision unit for a fire door which employs a few component parts, can be supplied in a kit form and readily installed into a door opening by a one-person operation. The vision unit member can withstand the most severe fire conditions yet be accommodated in door openings of various sizes and fabricated from readily available materials. The vision panel unit also offers versatility in the fabrication of the frame part members as well as a selection of the type of fastening means for securing the front and back panel members together, including tamperproof features.

The foregoing invention can now be practiced by those skilled in the art. Such skilled persons will know that the invention is not necessarily restricted to the particular embodiments presented herein but the scope of the invention is to be defined by the terms of the following claims as given meaning by the preceding description.

I claim:

1. A fire resistant vision unit for assembly in an opening in a door or the like comprising:

a first frame member adapted to be mounted in said opening to one side of said door;

a second frame member adapted to be mounted in said opening and to the opposite side of said door;

said first and second frame members having flange sections for extending over peripheral edges of said opening;

securing means clamping the first and second frame members to the door and to a transparent panel member support arms extending toward each other from said first and second frame members into said opening and defining an open holding channel;

said transparent panel member disposed in said channel;

wherein said support arms maintain said panel in place including times when said panel becomes semi-molten said support arms including inwardly biased sharp edge portions in contact with said panel member wherein said sharp edge portions will imbed in said panel member when said panel becomes semi-molten and;

at least one support element positioned between said first and second frame members and closing the open channel to support the bottom of said panel member.

2. The vision unit of claim 1 wherein said securing means is positioned in said door opening.

3. The vision unit of claim 1 furtaer including a pbiasing element extending between a wall surface of said door opening and one of said support arms.

4. The vision unit of claim 3 wherein said biasing element is defined by a spring member adapted for contact over a major portion of the width of said wall surface forming said door opening.

5. The vision unit of claim 1 wherein there are present two said support elements each of which include raised portions for supportable engagement with said support arms.

6. The vision unit of claim 1 wherein said edge portions for contacting said panel member are interconnected to said support arms by curved finger portions.

7. The vision unit of claim 1 wherein said first and second frame members are identical and said support arms are positioned at an angle of 90 degrees or approximately 15 degrees from being square with said frame member.

8. The vision unit of claim 1 wherein said frame members are initially fabricated in two parts and joined at the corners thereof by a weld type fastening.

9. The vision unit of claim 1 further including additional securing means for said frame members defined by interengageable tab and slot members operatively associated with said frame members.

10. The vision unit of claim 2 wherein said securing means is defined by threaded screw members positioned in close proximity to said edge portions.

11. The vision unit of claim 10 wherein said screw members are constructed and arranged in conjunction with at least one of said frame members to effect a tamper-proof arrangement.

12. The vision unit of claim 10 wherein said screw members are of the steel binder post type.

13. The vision unit of claim 10 wherein said threaded screw members are nut and screw elements with said nut element welded to one of said frame members.

14. An easily assembled window unit in a kit form for assembly by one person into a fire door opening comprising:

a first frame member adapted to be mounted in said door opening to one side of said door;

a second frame member adapted to be mounted in said opening and to the opposite side of said door;

said first and second frame members having flange sections for extending over peripheral edges of said opening;

securing means for clamping the first and second frame members to the door and to a fire resistant, transparent panel member support arms adapted to be positioned so as to extend from said first and second frame members into said opening to define an open continuous holding channel;

said fire resistant, transparent panel member constructed to be disposed in said channel;

wherein said support arms maintain said panel in place including times when said panel becomes semi-molten said support arms including inwardly biased sharp edge portions for directly contacting said panel member upon assembly of the window unit wherein said sharp edge portions will imbed in said panel member when said panel becomes semi-molten; and at least one support element for positioning between said first and second frame members and closing the open channel to support the bottom of said panel member.

15. The window unit of claim 14 wherein said securing means is adapted for positioning in said door opening.

16. The window unit of claim 14 further including a biasing element adapted to extend between a wall surface of said door opening and one of said support arms.

17. The window unit of claim 16 wherein said biasing element is defined by an elongated, clip-like spring member.

18. The window unit of claim 14 wherein there are present two said support elements each of which include raised portions for supportable engagement with said support arms.

19. The window unit of claim 14 wherein said edge portions for contacting said panel member are interconnected to said support arms by curved finger portions.

20. The window unit of claim 14 wherein said first and second frame members are identical and said support arms are positioned at an angle of 90 degrees or approximately 15 degrees from being square with said frame member.

21. The window unit of claim 14 wherein said frame members are initially fabricated in two parts and joined at the corners thereof by a weld type fastening.

22. The window unit of claim 14 wherein said securing means is defined by threaded screw members adapted to be positioned in close proximity to said edge portions.

23. The window unit of claim 22 wherein said screw members are constructed and arranged in conjunction with at least one of said frame members to effect a tamper-proof arrangement.

24. The window unit of claim 22 wherein said screw members are of the steel binder post type.

25. The window unit of claim 22 wherein said screw members are nut and screw elements with said nut element welded to one of said frame members.

* * * * *

UNITED STATES PATENT AND TRADEMARK OFFICE

CERTIFICATE OF CORRECTION

PATENT NO. : 4,550,542

DATED : November 5, 1985

INVENTOR(S) : Jack La See

It is certified that error appears in the above—identified patent and that said Letters Patent is hereby corrected as shown below:

Column 1, line 59, after "does" delete -- not --.

Column 7, Claim 3, line 60, "furtaer" should be -- further --.

Claim 3, line 60, "pbias-" should be -- bias- --.

Signed and Sealed this

*Ninth* Day of *September 1986*

[SEAL]

*Attest:*

DONALD J. QUIGG

*Attesting Officer* *Commissioner of Patents and Trademarks*